United States Patent [19]

Piltz et al.

[11] 4,103,802

[45] Aug. 1, 1978

[54] CLOSURE FOR A CONTAINER

[75] Inventors: Lars-Eric Piltz, Dalby; Jan-Bertil Jeppsson, Lomma, both of Sweden

[73] Assignee: AB Akerlund & Rausing, Lund, Sweden

[21] Appl. No.: 855,558

[22] Filed: Nov. 29, 1977

[30] Foreign Application Priority Data

Dec. 6, 1976 [SE] Sweden ..... 7613640

[51] Int. Cl.[2] ..... B65D 51/22

[52] U.S. Cl. ..... 220/258; 220/270; 229/43; 220/260

[58] Field of Search ..... 220/258, 266, 270, 260; 229/43, 51

[56] References Cited

U.S. PATENT DOCUMENTS

| | | | |
|---|---|---|---|
| 3,955,006 | 5/1976 | Sokolsky et al. | 229/43 X |
| 3,966,114 | 6/1976 | Schellenberg | 220/258 X |
| 4,037,748 | 7/1977 | Stubbs, Jr. | 220/270 |
| 4,044,941 | 8/1977 | Knudsen | 229/43 |
| 4,059,201 | 11/1977 | Foster | 220/258 |

*Primary Examiner*—George T. Hall

*Attorney, Agent, or Firm*—Lerner, David, Littenberg & Samuel

[57] ABSTRACT

A closure is provided and includes a sealing member and a cover for sealing and closing a container opening. The sealing member is sealed to the inner and outer walls of the container, and in one embodiment, an annular, ring-shaped element is provided for supporting the sealing member on the inside surface of the cover. In all embodiments, the cover includes a flange sealed to the external wall of the container, with the flange including a line of perforations forming a tear strip for removing the cover from the container. In the preferred embodiment, the removal of the cover causes the ring-shaped element to penetrate the sealing member and to form an annular opening in the sealing member so that the contents may be smoothly poured from the container.

19 Claims, 8 Drawing Figures

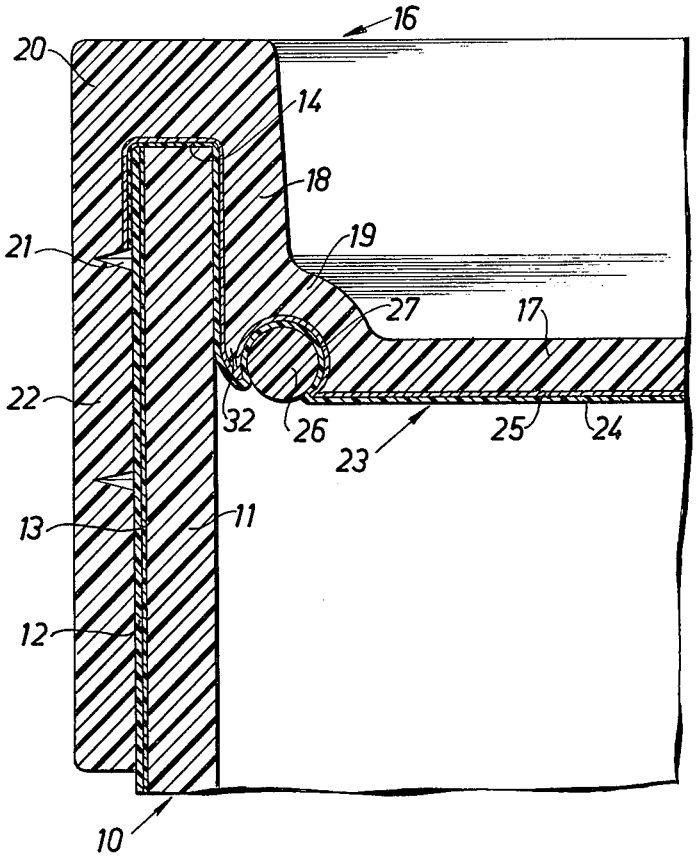
Fig. 5
Fig. 6
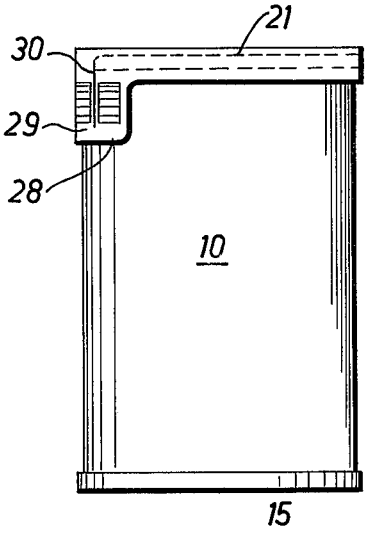

CLOSURE FOR A CONTAINER

FIELD OF THE INVENTION

The present invention relates to closures for containers, and more specifically to closures for containers which require a fluid-tight seal.

BACKGROUND OF THE INVENTION

It is well known to form the wall of a container from a plastic laminate which includes a layer of plastic and a layer of fluid impermeable material, such as aluminum foil. Such a container may be formed from extruding a sleeve of plastic, such as polypropylene. Typically, a laminate of aluminum foil and the same plastic material is laminated to the extruded plastic sleeve. It is also well known to form the bottom closure of the container by extrusion molding and to provide such a bottom closure with a layer of fluid impermeable material. Typically, the bottom closure is then sealed to the container sleeve as a last step in the manufacturing process. The aforedescribed construction of the container sleeve and bottom closure provides excellent characteristics with respect to fluid impermeability. However, a closure for such a container is required which does not jeopardize the fluid impermeability of the container, but the closure must still function to removably seal the container and the product contained therein. In addition to having such characteristics, the closure must also be relatively easy to open.

With regard to such closures for these types of packages, it is also known to construct same by attaching a sealing member to the inside surface of a cover. Typically, this may be done by laminating the sealing member, which may consist of a layer of aluminum foil disposed between two layers of plastic, to the inside surface of a plastic cover. The cover may also be provided with a center portion which is countersunk and is surrounded by a downwardly-extending groove which is substantially U-shape in cross section, so that the top edge of the container walls enter the U-shaped groove. Typically, a sealing member extends into the U-shaped groove and is sealed to the cover and the container walls. Such an arrangement typically provides a good, fluid-impermeable seal. However, in order to open the closure and penetrate the sealing member, a gripping member is typically formed as part of the cover and is provided with a tip which penetrates the sealing member and permits the tearing off of the center portion of the cover along a tearing strip. However, such an arrangement does not always provide a smooth transition between the container and the portions of the closure which remain attached to the container.

Accordingly, it is an object of the present invention to provide an improved closure which overcomes the aforesaid problem. Specifically, it is within the contemplation of the present invention to provide an improved closure for a container opening which provides a fluid-impermeable seal and which requires only one operation to remove the cover from the container and form an opening in the sealing member.

SUMMARY OF THE INVENTION

Briefly, in accordance with the principles of the present invention, an improved closure is provided and includes a sealing member and a cover to be attached to the container for closing the opening. The sealing member is sealed to the internal and external walls of the container, and in one embodiment, an annular ring element is provided for supporting the sealing member on the inside surface of the cover. The cover includes a flange portion attached to the external wall of the container, and the flange portion includes a line of perforations forming a tear strip for removing the cover from the container. In operation, when the cover is removed from the container, it causes the annular ring element to penetrate the sealing member and to form an opening in the sealing member close to the internal wall of the container so that the contents of the container may be smoothly poured out.

In a preferred embodiment, the annular ring element is attached in a groove formed on the inside surface of the cover adjacent to the internal wall of the container. In this embodiment, the sealing member is also disposed in the groove between the inside surface of the cover and the annular ring element. In an alternative embodiment, the sealing member is supported on the inside surface of the cover by a strip of hot-melt glue or similar adhesive extending around the opening of the container.

Advantageously, as a result of the construction of the closure of the present invention, when the cover is removed from the container opening, the sealing member is penetrated adjacent to the internal wall of the container and provides a substantially smooth opening for pouring out the contents of the container.

BRIEF DESCRIPTION OF THE DRAWINGS

Further objects, features, and advantages of the present invention will become apparent upon the consideration of the following detailed description of a presently preferred embodiment, when taken in conjunction with the accompanying drawings, wherein:

FIG. 5 is a partial sectional view of an alternative embodiment of a closure for a container embodying the present invention;

FIG. 6 is a side elevational view of the container and closure illustrated in FIG. 5;

DETAILED DISCUSSION OF PREFERRED EMBODIMENTS OF THE INVENTION

Figure 1:
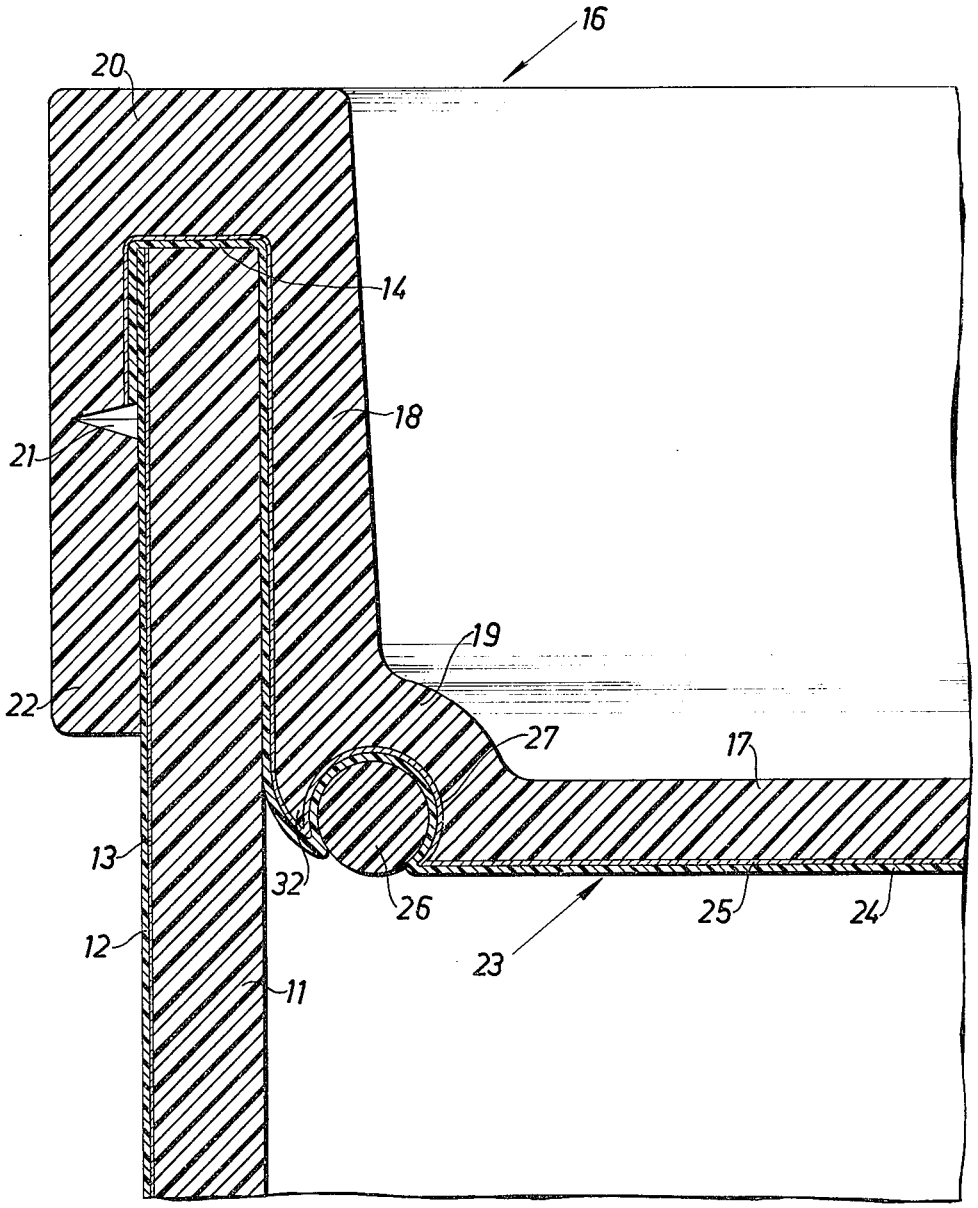
FIG. 1 is a partial sectional view of a closure for a container embodying the present invention.
Figure 3:
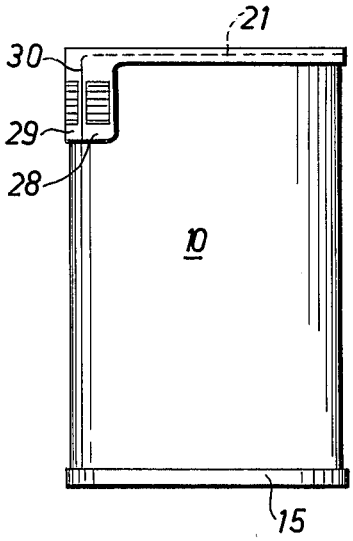
FIG. 3 is a side elevational view of the same container shown in FIG. 2 but seen from the opposite side.

Referring now to FIGS. 1 through 4, there is shown a container 10 for receiving the improved closure of the present invention which includes cover 16 and sealing member 23, as will be explained in detail herein.

The container includes an inner sleeve 11 of suitable plastic material, for example, polypropylene. Preferably, the sleeve 11 is extruded and calibrated to a suitable cross section. To the external side of the sleeve 11, there is laminated a laminate comprising an external plastic layer 12, for example, polypropylene, and a fluid-impermeable layer 13, such as aluminum foil.

To obtain this lamination, the laminate that comprises the layers 12, 13 is coated with a suitable binder which gives the intended attachment against the sleeve 11.

As appears from FIG. 1, the external laminate 12, 13 on the sleeve 11 extends all the way up to the top edge 14 of the sleeve. The container casing obtained in this manner is closed at the bottom portion thereof by means of a suitable, fluid-tight bottom closure 15 (FIG. 2), which preferably comprises the same combination of materials as the casing.

According to a preferred embodiment of the invention, the cover 16 forms the top of the package comprising the casing 11, 12, 13 and the bottom closure 15. Preferably, the cover 16 is manufactured from the same plastic material as the sleeve 11, for example, polypropylene. The cover 16 may be extruded directly onto the container casing or extruded before it is applied to the casing. The cover 16 is provided with a countersunk center portion 17 which extends substantially across the opening of the container essentially perpendicular relative the container casing. At its periphery, the cover 16 is provided with a first portion 18 abutting the inside wall of the container casing at the upper portion thereof. Between said portion 18 and the center portion 17, there is a transition region 19 having the shape of a bead or similar shape. Around the top edge 14 of the container casing, a second portion 20 of the cover extends. On the outside wall of the container casing, portion 20 extends to a tearing notch having the shape of a groove 21. On the external wall of the container casing, below the groove 21, the cover includes a flange 22.

The improved closure of the present invention also includes sealing member 23, comprising a plastic layer 24, for instance of polypropylene, facing the internal wall of the container, and a sealing layer 25, for instance, an aluminum foil, facing the cover and which is arranged on the inside surface of the cover 16. The layers 24, 25 of the sealing member 23 are laminated to each other, and the sealing member 23 extends along the underside of the entire center portion 17 past the underside of the bead-shaped portion 19, in a manner which is to be described later. The sealing member 23 also extends along portions 18, 20 of the cover and all the way around to the tearing notch 21, between the second portion 20 of the cover and the flange 22. Since the first and second portions 18, 20 of the cover tightly abut and encompass the inside wall, the top edge 14 and the external wall of the container, respectively, and since the layer 24 of the sealing member 23 facing the container casing consists of plastic material, preferably the same material as the sleeve 11 and the outer layer 12 of the casing, it is easy to obtain a good seal between sealing member 23 and these regions of the container casing. Since the free side of the aluminum foil 25 of the sealing member 23 is not covered with any binder, sealing is, however, not obtained between said foil and the material of the cover 16.

The support of the sealing member 23 on the underside of the cover 16, in the manner shown in FIG. 1, is obtained by means of a special support device 26. In this embodiment, device 26 comprises an annular element, circular in cross section and extending close to the inside wall of the container casing along the entire circumference thereof. The element 26 is supported mechanically in a groove 27 in the bead-shaped portion 19 of the cover. As mentioned above, the cover 16 is preferably extrusion molded, so it is easy to obtain the groove 27 by first sealing the annular element 26 against sealing member 23, whereby the element 26 preferably consists of the same plastic material as the material in layer 24 of sealing member 23. After this sealing of element 26 to sealing member 23, they may be placed on the top of the container, whereafter, by means of a suitable mold device, the desired contour and shape of cover 16 is obtained. Of course, the cover 16 may also be extrusion molded before it is placed on the container.

The flange 22 of the cover 16 is sealed to the outer layer 12 of the container casing, for instance, by welding, or in any other suitable manner. As mentioned above, sealing member 23 extends all the way down to the tearing notch 21. Along the regions of abutment against the container casing, the sealing member is sealed thereto. As a result, the cover provides excellent fluid impermeability and is securely attached to the container by means of the flange 22.

Figure 2:
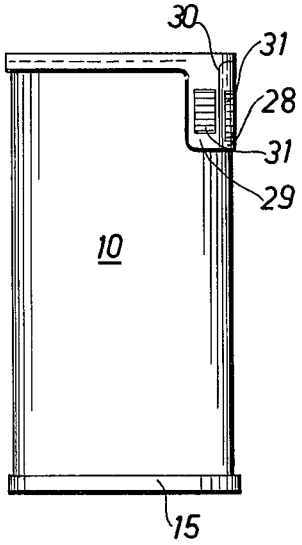
FIG. 2 is a side elevational view illustrating the container and closure shown in FIG. 1.
Figure 4:
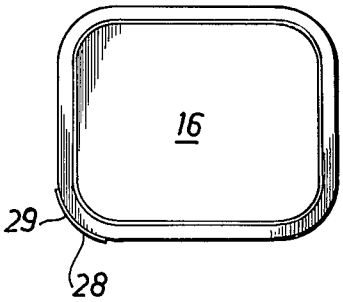
FIG. 4 is a top plan view of the closure for the container of the present invention.

In order to easily remove the cover 16 from the top of the container, a tearing lug 28 is provided (FIG. 2). Preferably, this lug is placed adjacent to an opening lug 29. Between the lugs 28, 29, there is an open groove 30 which, in the transition region between the flange 22 and the second portion 20 of the cover 16, merges into the groove 21.

Thus, by gripping tearing lug 28 and completely breaking through the groove 30 and continuing to tear off the flange 22 from the external wall of the container casing all the way around the container, finally one reaches the opening lug 29. In the same manner as for the tearing lug 28, the opening lug 29 is provided with a suitable grip indication 31 that facilitates the gripping of the lug. By pulling the opening lug 29 upwardly, the remaining part of the cover will be forced upwardly. Since the sealing member 23 is sealed to the container casing at the inside thereof, at the top edge 14 and in a smaller region on the external wall of the container casing, there will be a strain in the sealing member between the ring-shaped element 26 and the inside wall of the container casing. In this region, adjacent the element 26, preferably in the cover 16, there is a curved tip portion 32 extending the entire way around the opening of the container. This tip 32 facilitates the breaking through of sealing member 23 when the cover 16 is pushed upwards by means of the opening lug 29.

The groove 27 in which the ring-shaped element 26 is disposed is dimensioned such that the element 26 does not leave the groove 27 when displacing the cover upwards. The groove 27 preferably accommodates an angular arc larger than 180°.

Since sealing member 23 will be penetrated at a very short distance from the internal walls of the container casing, there is obtained a completely smooth pouring opening. The portion of the sealing member still adhering to the container is so thin that it does not affect the discharging of the contents of the package.

As mentioned above, after support 26 and sealing member 23 are mounted on the opening of the container, the cover 16 may be extrusion molded directly onto the container. In that case, the flange portion 22 and the tearing lug and opening lug, respectively, are manufactured in positions 180° upwardly from the final position. This is due to the practical shaping of the extrusion-molding tool. Due to the resilience of the material, said elements may be folded down against the outside wall of the container casing and sealed in a suitable manner after the extrusion molding has been finished.

Some possible modifications are illustrated in FIGS. 5 through 8. In FIGS. 5 and 6, the center portion 17 is displaced axially upwards. In addition, the single groove tearing arrangement 21 in the previous embodiment is replaced by a twin-groove arrangement.

Figure 7:
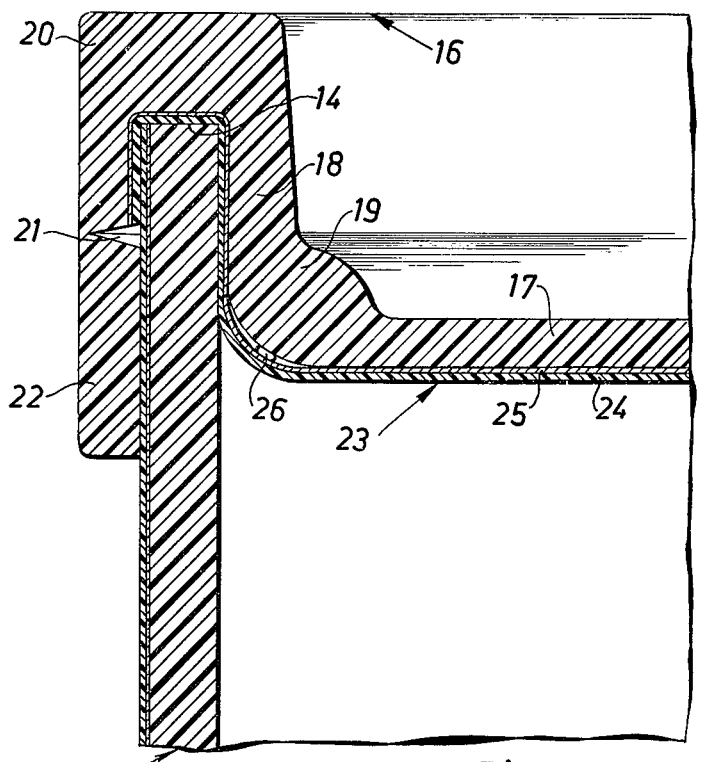
FIG. 7 is a partial sectional view of a third alternative embodiment of a closure embodying the present invention.

In the embodiment of FIG. 7, the support device 26 for the sealing member 23 consists of a string 26 of hot-melt glue or similar adhesive extending around the entire circumference of the top of the container.

Figure 8:
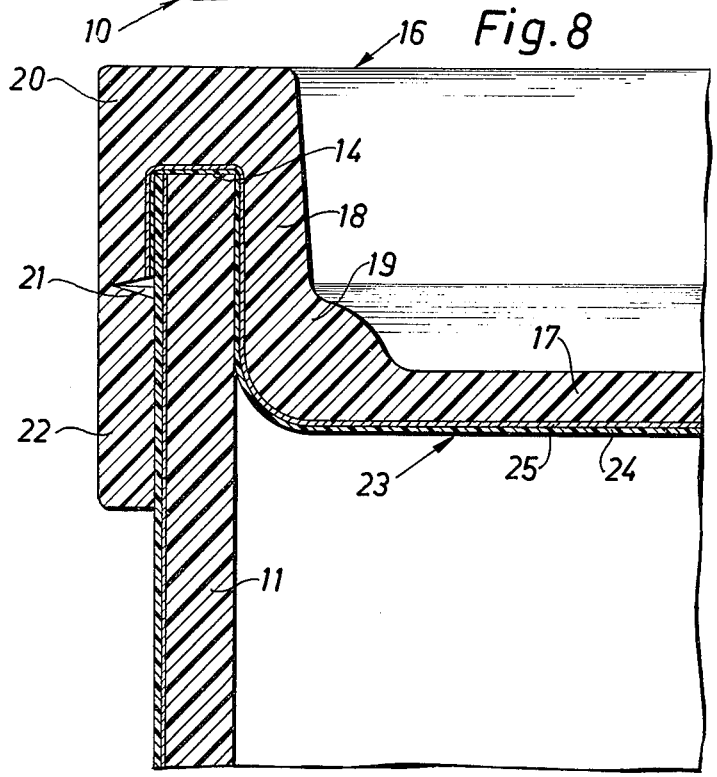
FIG. 8 is a partial sectional view of a fourth alternative embodiment of a closure embodying the principles of the present invention.

The embodiment shown in FIG. 8 does not include any means for automatically penetrating the sealing member 23 when removing the cover 16 by means of the opening lug 29. Instead, the sealing member 23 is supported only by the attachment to the casing. After the removal of cover 16, an opening is formed in member 23 by means of a separate tool.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A closure for sealing an opening of a container, comprising:

a sealing member for sealing the opening of said container, a cover to be attached to said container for closing said opening, means for attaching said sealing member to said container and for supporting said sealing member on the inside surface of said cover, said cover including a flange attached to the external wall of said container, and said flange including a weakened area forming a tear strip for removing said cover from said container.

2. A closure in accordance with claim 1 wherein said supporting means includes a support device for forming an opening in said sealing member when said cover is removed from said container.

3. A closure in accordance with claim 1 wherein said supporting means includes a support device extending about the opening of said container adjacent to the internal wall of said container for forming an opening in said sealing member when said cover is removed from said container.

4. A closure in accordance with claim 2 wherein said support device is an annular ring element attached in a groove formed on the inside surface of said cover adjacent to the internal wall of said container.

5. A closure in accordance with claim 4 wherein said sealing member is disposed in said groove between said cover and said annular ring element.

6. A closure in accordance with claim 2 wherein said support device is a strip of adhesive extending about the periphery of said container opening.

7. A closure in accordance with claim 1 wherein the central portion of said cover is countersunk, and said cover includes peripheral portions abutting the internal, top, and external walls of said container.

8. A closure in accordance with claim 1 wherein said sealing member is attached to the internal and external walls of said container.

9. A closure in accordance with claim 1 wherein said flange further includes a tearing lug, and said weakened area extends from said tearing lug about the container.

10. A closure in accordance with claim 1 wherein said tear strip is attached to a gripping lug to be gripped for removing said cover from said container.

11. A closure in accordance with claim 1 wherein said container is a laminate of plastic material and fluid-impermeable material, and said sealing member is a laminate of plastic material and fluid-impermeable material.

12. A closure in accordance with claim 11 wherein the fluid-impermeable material of said sealing member faces the inside surface of said cover and the plastic material of said sealing member abuts the internal wall of said container.

13. A closure in accordance with claim 12 wherein the plastic material of said sealing member is sealed to the internal and external walls of said container.

14. A closure member in accordance with claim 2 wherein said support device is an annular ring element having a substantially circular cross section, and is disposed in a groove having a cross section defined by a circular arc larger than 180°.

15. A closure in accordance with claim 4 wherein said ring element is sealed to said sealing member to facilitate the forming of an opening in said sealing member when said cover is removed.

16. A closure in accordance with claim 1 wherein said cover includes a tip portion for facilitating the forming of an opening in said sealing member when said cover is removed from said container.

17. A closure in accordance with claim 1 wherein said flange includes two lines of perforation to form a double tear strip.

18. A closure in accordance with claim 1 wherein said cover includes a tearing lug and a gripping lug and said weakened area further includes an open groove extending between said tearing lug and said gripping lug.

19. A closure in accordance with claim 1 wherein said cover is extrusion molded directly onto said container opening.

* * * * *